US009492045B2

(12) United States Patent
Conrad

(10) Patent No.: US 9,492,045 B2
(45) Date of Patent: Nov. 15, 2016

(54) FILTER ASSEMBLY FOR A SURFACE CLEANING APPARATUS

(75) Inventor: Wayne Ernest Conrad, Hampton (CA)

(73) Assignee: Omachron Intellectual Property Inc., Hampton, Ontario (CA)

( * ) Notice: Subject to any disclaimer, the term of this patent is extended or adjusted under 35 U.S.C. 154(b) by 427 days.

(21) Appl. No.: 13/416,155

(22) Filed: Mar. 9, 2012

(65) Prior Publication Data

US 2013/0232722 A1 Sep. 12, 2013

(51) Int. Cl.

| | |
|---|---|
| ***A47L 5/28*** | (2006.01) |
| ***A47L 9/16*** | (2006.01) |
| ***A47L 9/10*** | (2006.01) |
| ***A47L 9/12*** | (2006.01) |
| ***A47L 9/20*** | (2006.01) |

(52) U.S. Cl.

CPC ..... *A47L 5/28* (2013.01); *A47L 9/106* (2013.01); *A47L 9/122* (2013.01); *A47L 9/127* (2013.01); *A47L 9/16* (2013.01); *A47L 9/1666* (2013.01); *A47L 9/1683* (2013.01); *A47L 9/20* (2013.01)

(58) Field of Classification Search

CPC . A47L 9/1666; A47L 9/1683; A47L 9/1641; A47L 9/1625; A47L 9/1633; A47L 7/0028; A47L 7/0038; A47L 7/0042

USPC ..... 15/350, 352, 353, 347; 55/337, 426, 55/429

See application file for complete search history.

(56) References Cited

U.S. PATENT DOCUMENTS

| | | | | |
|---|---|---|---|---|
| 5,230,722 | A * | 7/1993 | Yonkers | 55/337 |
| 6,113,663 | A * | 9/2000 | Liu | 55/459.1 |
| 6,775,882 | B2 * | 8/2004 | Murphy | A47L 5/28 15/352 |
| 7,708,789 | B2 * | 5/2010 | Fester | A47L 9/127 15/350 |
| 8,206,482 | B2 * | 6/2012 | Williams | B01D 46/2414 156/184 |
| 2001/0018865 | A1 | 9/2001 | Wegelin et al. | |
| 2007/0067943 | A1 * | 3/2007 | Makarov | 15/339 |

(Continued)

FOREIGN PATENT DOCUMENTS

| | | | |
|---|---|---|---|
| JP | 03176019 | A | 7/1991 |
| WO | 9930602 | A2 | 6/1999 |

(Continued)

OTHER PUBLICATIONS

International Search Report, as received in connection to international patent application No. PCT/CA2013/000121.

(Continued)

*Primary Examiner* — Robert Scruggs
(74) *Attorney, Agent, or Firm* — Philip C. Mendes da Costa; Bereskin & Parr LLP/ S.E.N.C.R.L., s.r.l.

(57) ABSTRACT

A surface cleaning apparatus comprises an air flow passage extending from a dirty air inlet to a clean air outlet, a cyclone positioned in the air flow passage and having a cyclone air inlet, a cyclone air outlet and having a cyclone axis, a suction motor positioned in the air flow passage and having a motor axis, and a filter assembly downstream of the cyclone air outlet and upstream of the suction motor, the filter assembly comprising a longitudinally extending filter axis that may be generally parallel to the cyclone axis, spaced apart longitudinally extending upstream and downstream air flow passages and a longitudinally extending filter media therebetween some. In some embodiments, at least a portion of one of the upstream and downstream air flow passages is positioned interior the filter media.

28 Claims, 17 Drawing Sheets

(56) References Cited

U.S. PATENT DOCUMENTS

| | | | | |
|---|---|---|---|---|
| 2008/0178416 | A1 | 7/2008 | Conrad | |
| 2010/0236016 | A1* | 9/2010 | Tran | A47L 9/1472 15/347 |
| 2010/0299866 | A1* | 12/2010 | Conrad | A47L 5/24 15/353 |
| 2011/0219575 | A1 | 9/2011 | Conrad | |

FOREIGN PATENT DOCUMENTS

| | | | |
|---|---|---|---|
| WO | 2008070969 | A1 | 6/2008 |
| WO | 2008070970 | A1 | 6/2008 |
| WO | 2008070971 | A1 | 6/2008 |
| WO | 2008070972 | A1 | 6/2008 |
| WO | 2008070974 | A1 | 6/2008 |
| WO | 2008070975 | A1 | 6/2008 |

OTHER PUBLICATIONS

Abstract of the Japanese Patent Publication No. JP03176019A, as received in connection to international patent application No. PCT/CA2013/000121.

* cited by examiner

FILTER ASSEMBLY FOR A SURFACE CLEANING APPARATUS

FIELD

This invention relates to a surface cleaning apparatus. In one particular embodiment, the surface cleaning apparatus is a cyclonic cleaning apparatus, such as a cyclonic surface cleaning apparatus and may be an upright vacuum cleaner. The surface cleaning apparatus is provided with an elongate filter compartment, which is preferably upstream of the suction motor.

INTRODUCTION

Previous different constructions for a surface cleaning apparatus, such as a vacuum cleaner, are known in the art. Currently, vacuum cleaners, which utilize cyclonic cleaning stages, are known. Such devices may use one or two cyclonic cleaning stages. Typically, a pre-motor foam filter and a post-motor filter, such as a HEPA filter, may be provided. The pre-motor filter may be shaped as a disc so as to be positioned in the air flow passage from the cyclonic cleaning stage or stages to the suction motor. Accordingly, the pre-motor filter is relatively thin compared to its diameter in the direction of air flow through the passage. The pre-motor filter is designed to prevent hair and dirt which may exit the cyclonic cleaning stage from reaching the suction motor where it may cause damage to the suction motor. The post-motor HEPA filter is designed to filter carbon dust and other fine particulate matter which is in the air stream that has travelled past by the suction motor.

The carpet cleaning efficiency of a vacuum cleaner depends upon the velocity of the air flow at the dirty air inlet in the floor or the surface cleaning head. The greater the velocity, the greater the amount of particulate matter that may be entrained in the air flow entering the vacuum cleaner, and, in addition, the heavier the dirt particles that may be entrained in the air flow entering the vacuum cleaner. As the pre-motor filter becomes clogged, the back pressure through the vacuum cleaner will increase, thereby reducing the velocity of the air flow at the dirty air inlet. Accordingly, the pre-motor filter should, on occasion, be cleaned or replaced. Typically, consumers may not clean or replace this filter. Accordingly, over time, the performance of a vacuum cleaner will decrease.

In accordance with one broad aspect of this disclosure, a surface cleaning apparatus is provided which provides a filter downstream of a cyclone, and, preferably, upstream of the suction motor, which has an enhanced surface area. The surface area of the pre-motor filter is enhanced by configuring the pre-motor filter to extend longitudinally (e.g. the filter is an elongate filter member). For example, the face of the filter that has the greatest length may extend in a direction of air flow upstream of downstream of the filter (e.g., it may be generally parallel to the suction motor axis or the cyclone axis). Such a design may require the treated air exiting a cyclone to travel laterally through the filter. The longitudinally extending sides of the pre-motor filter are utilized to define the upstream surface of the pre-motor filter. This is in contrast with a typical design wherein the face of a filter having the greatest surface area is position facing the direction of air flow in the vacuum cleaner.

An advantage of this design is that a pre-motor filter having a substantially larger upstream surface may be provided. Accordingly, even if a consumer does not replace or clean the pre-motor filter, the cleaning efficiency of a vacuum cleaner may be maintained over a longer operating period.

In accordance with another aspect of this invention, the elongate filter member may be positioned aligned with (e.g. above or below) a cyclone. Accordingly, even though the air may travel axially from a cyclone outlet to the pre-motor filter, the upstream surface area of the pre-motor filter may still be enhanced. Further, this may be achieved without increasing the footprint of a vacuum cleaner. Accordingly, a vacuum cleaner, when viewed from above, may still be constructed that has a relatively small cross-section area (i.e. footprint).

In accordance with one broad aspect of this disclosure, there is provide a surface cleaning apparatus comprising:

- an air flow passage extending from a dirty air inlet to a clean air outlet;
- a cyclone positioned in the air flow passage and having a cyclone air inlet, a cyclone air outlet and having a cyclone axis;
- a suction motor positioned in the air flow passage and having a motor axis; and,
- a filter assembly downstream of the cyclone air outlet and upstream of the suction motor, the filter assembly comprising a longitudinally extending filter axis that is generally parallel to the cyclone axis, spaced apart longitudinally extending upstream and downstream air flow passages and a longitudinally extending filter media therebetween.

In accordance with another broad aspect of this disclosure, there is provide a surface cleaning apparatus comprising:

- an air flow passage extending from a dirty air inlet to a clean air outlet;
- a cyclone positioned in the air flow passage and having a cyclone air inlet, a cyclone air outlet and having a cyclone axis;
- a suction motor positioned in the air flow passage and having a motor axis; and,
- a filter assembly downstream of the cyclone air outlet and upstream of the suction motor, the filter assembly comprising a longitudinally extending filter axis, spaced apart longitudinally extending upstream and downstream air flow passages and a longitudinally extending filter member therebetween wherein at least a portion of one of the upstream and downstream air flow passages is positioned interior the filter media.

Any of the embodiments described herein may have one or more of the following features.

The longitudinally extending filter axis may be generally parallel to the motor axis.

The filter assembly may have a downstream end having a dirt collection recess.

The filter media may comprise a hollow body having at least one longitudinally extending peripheral wall.

The filter media may be annular.

The filter assembly may have an upstream end and a downstream end and the filter assembly further may comprise a longitudinally extending filter support wall having a central portion with a plurality of openings and a solid portion adjacent the downstream end.

The filter assembly may comprise a spaced apart outer wall facing the filter support wall, and the filter media is positioned adjacent the filter support wall and may overlie the central portion and at least part of the downstream solid portion.

The filter media may be positioned on an outer side of the filter support wall, the longitudinally extending upstream air flow passage may be positioned between the outer wall and the filter media and the longitudinally extending downstream air flow passage maybe positioned on an inner side of the filter support wall.

The filter media may be annular and the longitudinally extending downstream air flow passage may be positioned inside the filter media.

The longitudinally extending upstream airflow passage may have a dirt collection recess at the downstream end.

The filter media may be positioned on an inner side of the filter support wall, the longitudinally extending downstream air flow passage may be positioned between the outer wall and the filter media and the longitudinally extending upstream air flow passage may be positioned on an inner side of the filter support wall.

The filter media may be annular and the longitudinally extending upstream airflow passage may be positioned inside the filter media.

The longitudinally extending upstream airflow passage may have a dirt collection recess at the downstream end.

The longitudinally extending downstream air flow passage may have an end open adjacent the upstream end and the filter media may overlie the open end.

The longitudinally extending filter support wall may comprise a solid portion adjacent the upstream end and the filter media also may overlie at least part of the upstream solid portion.

The longitudinally extending downstream air flow passage may have an end open adjacent the upstream end and the filter media may overlie the open end.

The filter media may comprise a foam filter.

The filter media may comprise a longitudinally extending foam filter and a downstream longitudinally extending felt filter.

The filter media may be compressed between the upstream and downstream ends.

The filter media may be compressed against the filter support wall.

The filter member may comprise a hollow body.

The filter member may comprise an annular body.

The filter assembly may have an upstream end and a downstream end and the filter assembly further may comprise a longitudinally extending filter support wall having a plurality of openings and the filter member is positioned adjacent the filter support wall.

The filter assembly may have an upstream end and a downstream end, the longitudinally extending filter support wall may have a central portion with a plurality of openings and solid portions adjacent the upstream and downstream ends and the filter member may overlie the central portion and at least part of the upstream and downstream solid portions.

The filter assembly may have an upstream end and a downstream end, the longitudinally extending filter support wall may have a central portion with a plurality of openings and a solid portion adjacent the downstream end, the filter member may overlie the central portion and at least part of the downstream solid portion, the longitudinally extending downstream air flow passage may have an end open adjacent the upstream end and the filter member may also overlie the open end.

The longitudinally extending filter axis may be generally parallel to the motor axis.

The longitudinally extending filter axis may be generally parallel to the cyclone axis.

DRAWINGS

These and other advantages of the surface cleaning apparatus of this disclosure will be more and fully understood in conjunction with the following description of the preferred embodiments of the disclosure in which.

Figure 28:
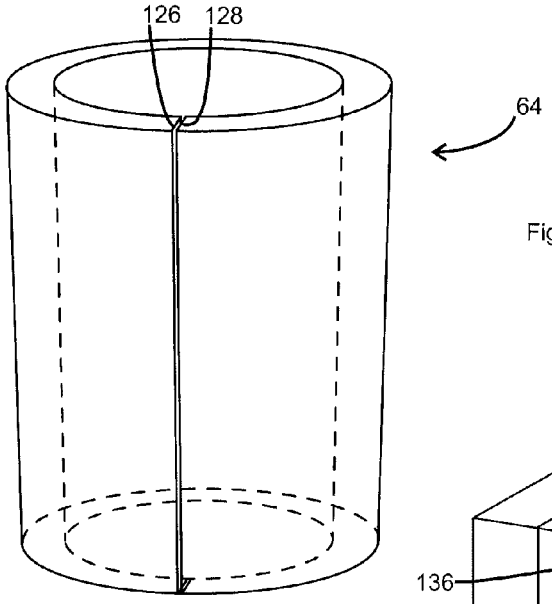
Figure 29:
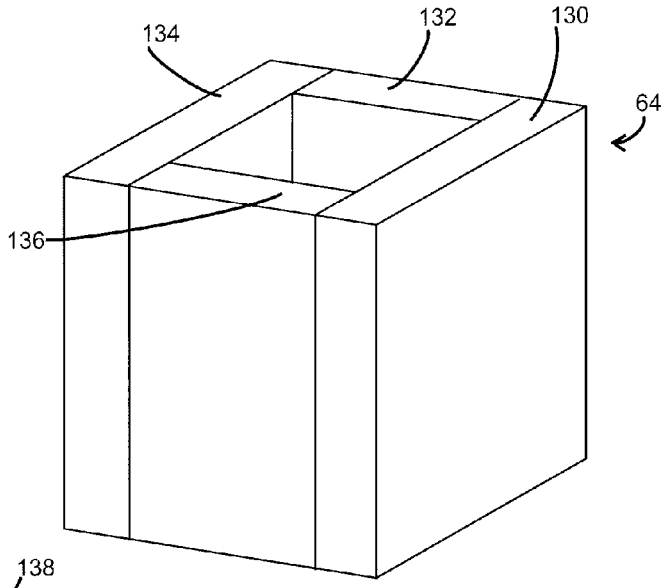
Figure 30:
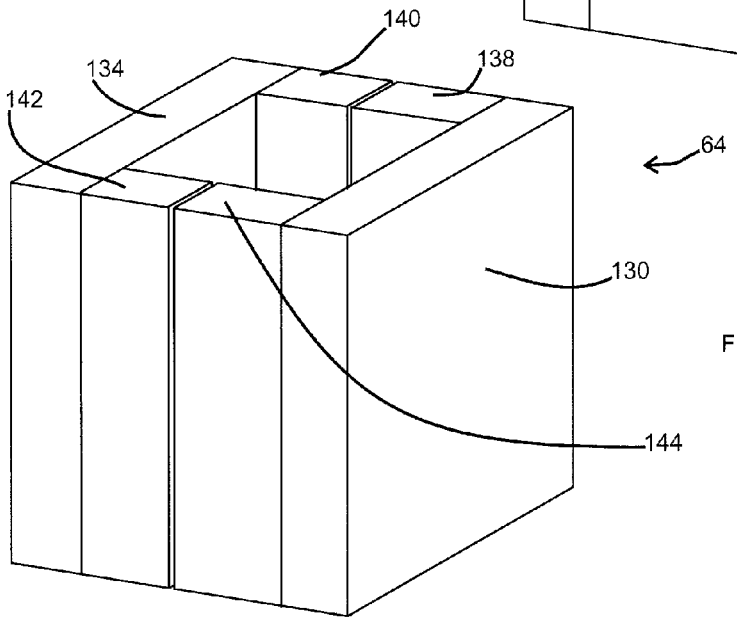

FIG. 28 exemplifies one construction technique for a pre-motor filter according to this disclosure;

FIG. 29 exemplifies an alternate construction for a pre-motor filter according to this invention; and, FIG. 30 exemplifies a further alternate construction for a pre-motor filter according to this invention;

DESCRIPTION OF VARIOUS EMBODIMENTS

Figure 1:
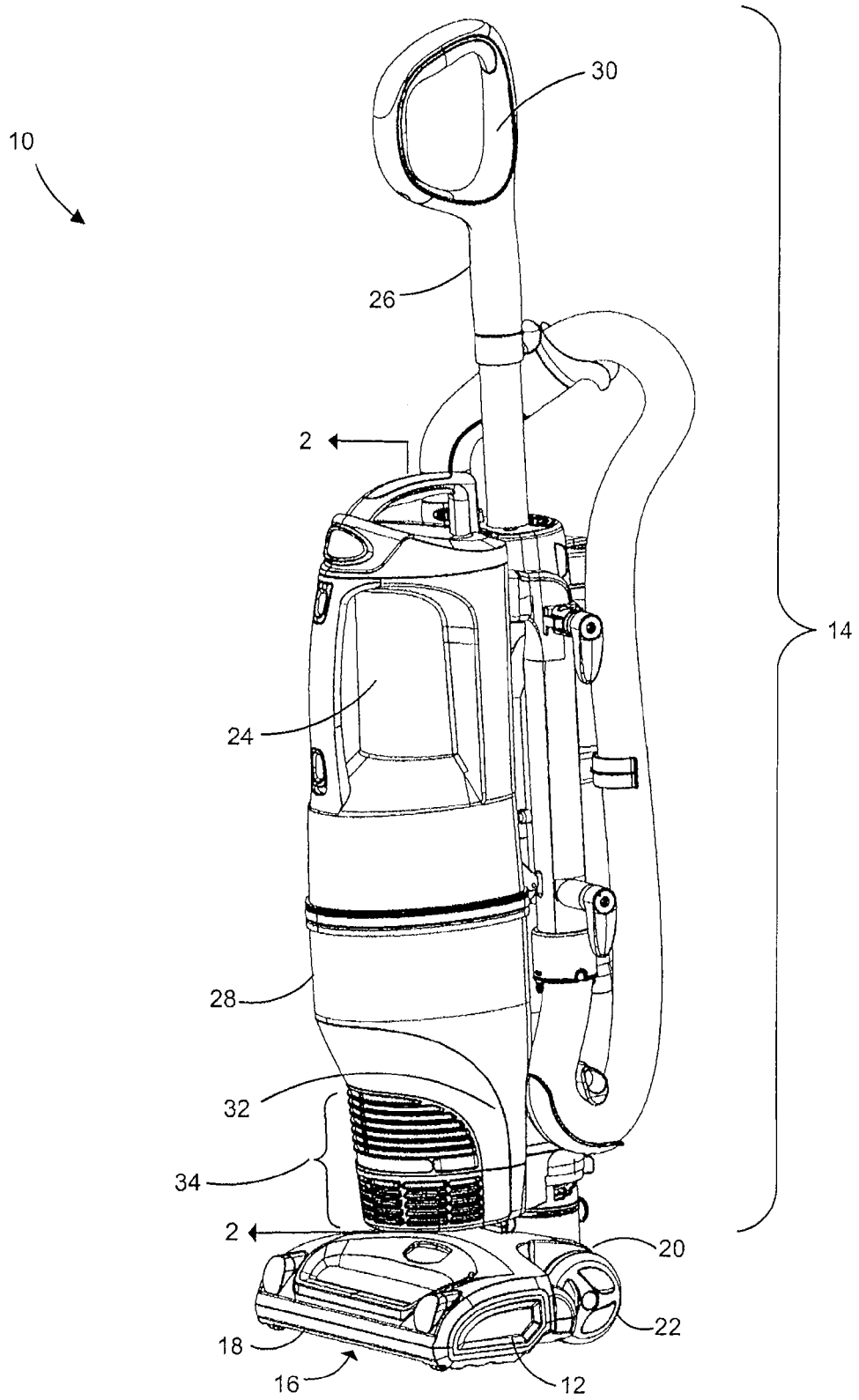
FIG. 1 is a perspective view of a vacuum cleaner according to a preferred embodiment.

Referring to FIG. 1, an embodiment of a surface cleaning apparatus 10 is shown. In the embodiment illustrated, the surface cleaning apparatus 10 is an upright surface cleaning apparatus. In alternate embodiments, the surface cleaning apparatus may be another suitable type of surface cleaning apparatus, including, for example, a hand vacuum cleaner, a canister vacuum cleaner, a stick vac, a wet-dry vacuum cleaner and a carpet extractor. The surface cleaning apparatus is preferably a vacuum cleaner.

As exemplified in FIG. 1, upright surface cleaning apparatus 10 comprises a surface cleaning head or floor cleaning head 12 and an upper section 14 which is moveably mounted to surface cleaning head 12.

Surface cleaning head 12 may be any surface cleaning head known in the art. As exemplified, surface cleaning 12 has a dirty air inlet 16, a front end 18, a rear end 20 and optionally, a plurality of wheels 22. Surface cleaning head may be of any design known in the art.

Upper section 14 is moveably mounted (e.g. pivotally mounted) to surface cleaning head 12 by any means known in the art and is movable between an upright storage position as exemplified in FIG. 1 and an inclined in use position. For example, when it is desired to use surface cleaning apparatus 10, a user may grasp hand grip portion 30 of handle 26 so as to move upper section 14 into a reclined position as is typically used with upright vacuum cleaners.

Upright section 14 may be any upright section known in the art. Preferably, as exemplified, upright section 14 has one or more air treatment members, such as cyclone 24, a suction motor 36 and handle 26. The suction motor 36 is provided in suction motor housing 28. The handle 26 is preferably drivingly connected to the surface cleaning head 12 to permit handle 26 to be used to steer the surface cleaning head 12. In other embodiments, it will be appreciated that suction motor 36 may be provided elsewhere, such as in surface cleaning head 12.

It will be appreciated that surface cleaning apparatus 10 may utilize any air treatment members known in the art. Preferably the air treatment member comprises at least one cyclone and may utilize a plurality of cyclonic cleaning stages. Other air treatment members such as filter bags or the like may also be used. It will also be appreciated that one or more of the air treatment members and/or the suction motor may be provided elsewhere such as in floor cleaning head 12.

Figure 2:
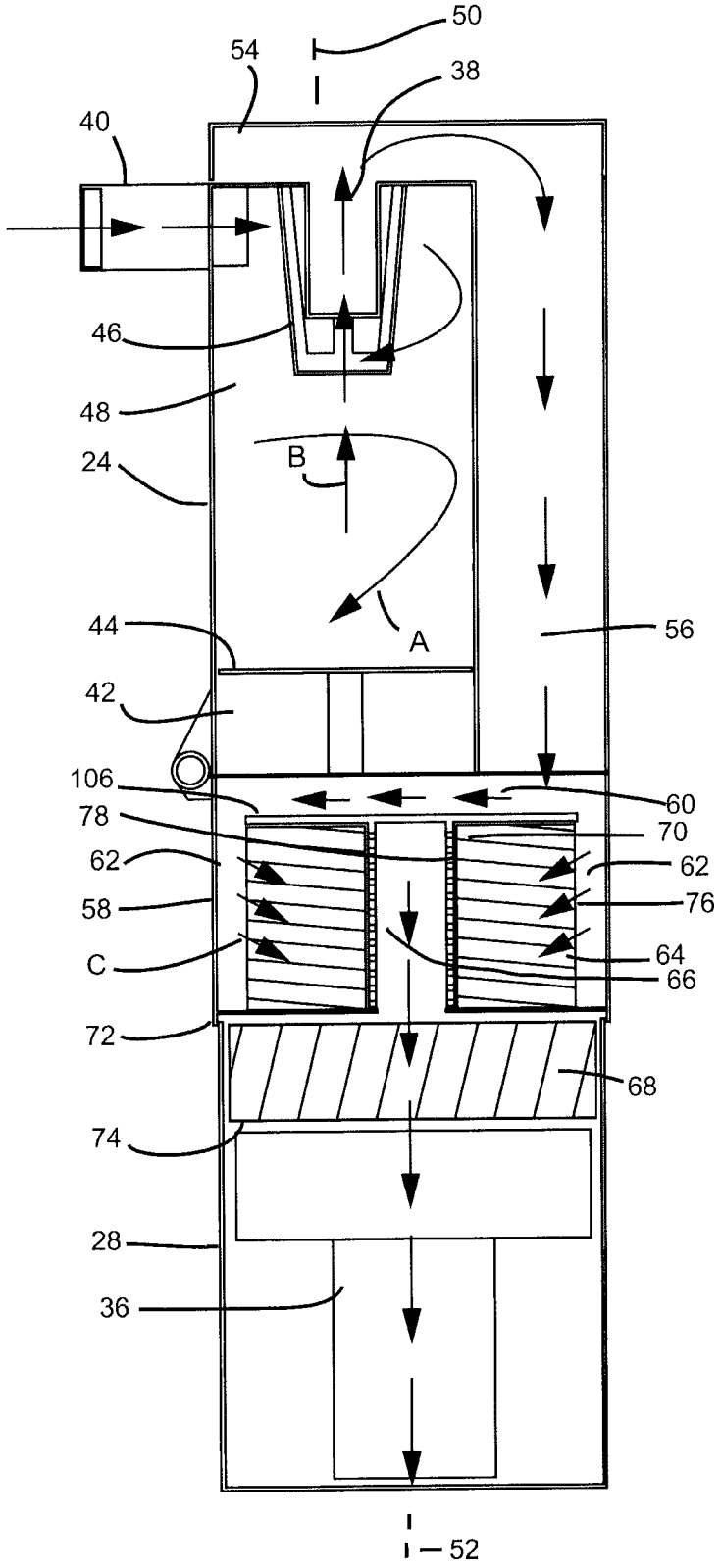
FIG. 2 is a vertical section through a cyclone, pre-motor filter and a suction motor according along line 2-2 in FIG. 1.

As exemplified in FIG. 2, cyclone 24 has a cyclone air inlet (which is preferably a tangential air inlet and which is provided at the upper end of cyclone 24. The air circulates in the cyclone chamber 48 as shown schematically by arrow A. Entrained dirt and other matter may be separated from the air as it rotates in cyclone chamber 48. The separated material may pass downwardly past plate 44 into dirt collection chamber 42. The air then travels upwardly as shown by arrow B through screen 46 and out vortex finder or cyclone outlet 38. Accordingly, as exemplified, cyclone 24 has an air inlet and an air outlet at the upper end thereof and the dirt is collected in a separate dirt collection chamber 42 which is isolated or separated from the cyclone chamber 48. It will be appreciated that cyclone 24 may be of any other design known in the art. For example, the dirt collection chamber may comprise a lower portion of cyclone chamber 48 (e.g. a plate 44 may not be provided). Alternately, the cyclone may be an inverted cyclone (e.g. the dirt exit may be at the upper end thereof). In addition, a dirt collection chamber may be positioned exterior and adjacent to cyclone chamber 24 (such as by having a dirt exit in a sidewall of cyclone 24). It will also be appreciated that cyclone 24 may be at any particular orientation with respect to the surface cleaning apparatus 10. As shown in FIG. 2, cyclone 24 has a cyclone axis 50 which extends vertically.

At the bottom of the housing shown in FIG. 2, suction motor 36 is provided. Suction motor 36 is oriented with an impeller or rotor positioned at the top and the motor which drives the impeller positioned there below. Suction motor 36 has a motor axis 52. It will be appreciated that motor 36 may be at various different orientations and may be of different configurations as is known in the art. It will be appreciated that suction motor 36 may be of any design known in the art. Preferably, suction motor 36 is positioned below cyclone 24, and accordingly, may be provided in a lower portion of upper section 14. It will be appreciated that, in alternate embodiments, suction motor 36 may optionally be provided above cyclone 24, for example, at the upper end of upper section 14.

As exemplified in FIG. 2, suction motor 36 is preferably positioned with suction motor axis 52 parallel to cyclone axis 50 and, more preferably co-axial or generally co-axial, i.e., cyclone axis 50 and suction motor axis 52 are laterally spaced apart slightly. It will be appreciated that, in other configurations, cyclone axis 50 and suction motor axis 52 may not be parallel, or, alternately, they may be co-axial (i.e. they may not be laterally spaced apart).

A post motor filter, which may be in a post motor filter housing 32, is preferably provided. As exemplified, post motor filter housing 32 may be provided on upper section 14 and is preferably adjacent (e.g., below) the suction motor 36. Alternately, the post motor filter may be provided in the surface cleaning head or at any other desired location.

As exemplified, clean air outlet 34 comprises a grill on a forward face of post motor filter housing 32 as well as a portion of suction motor housing 28. It will be appreciated that the clean air outlet 34 may be provided on a portion or all of one or both of suction motor housing 28 and post motor filter housing 32. Alternately, the clean air outlet 34 may be provided in the surface cleaning head or at any other desired location.

In operation, air is drawn in through dirty air inlet 16 and transferred via one or more conduits to cyclone 24. The air exits cyclone 24 via cyclone air outlet 38 and is then conveyed by one or more conduits, preferably through a pre motor filter, to a position above suction motor 36. For example, as exemplified in FIG. 2, the air exits cyclone 24 by an outlet 38 and may enter a header or plenum 54. The treated air may then travel laterally to enter down flow conduit 56. At the bottom of down flow conduit 56 the air enters pre-motor filter housing 58. Preferably, as exemplified, pre-motor filter housing 58 is provided with a header or plenum 60 which is upstream of longitudinally extending upstream air flow passage 62. The air may travel from longitudinally extending upstream air flow passage 62 inwardly or transversally through longitudinally extending filter 64 into longitudinally extending downstream air flow passage 66. The air may then exit pre-motor filter housing 58 and travel to suction motor 36. The treated air then passes by suction motor 36, through an optional post motor filter (which is preferably a HEPA filter) and may then exit via clean air outlet 36.

Referring again to FIG. 2, suction motor housing 28 may be provided with a typical pre-motor filter 68 which is disc shaped. It will be appreciated that, in alternate embodiments, a disc shaped pre-motor filter 68 may not be provided, in which case, if filter 64 is upstream of suction motor 36, then filter 64 may be the pre-motor filter. Alternately, the pre-motor filter 68 may be provided as part of the pre-motor filter housing 58. In addition, pre-motor filter 68 may be made of the same material as the filter 64 or may be made of a finer filter material. For example, if longitudinally extending filter 64 is made from foam, then pre-motor filter 68 may be, e.g., felt.

Figure 5:
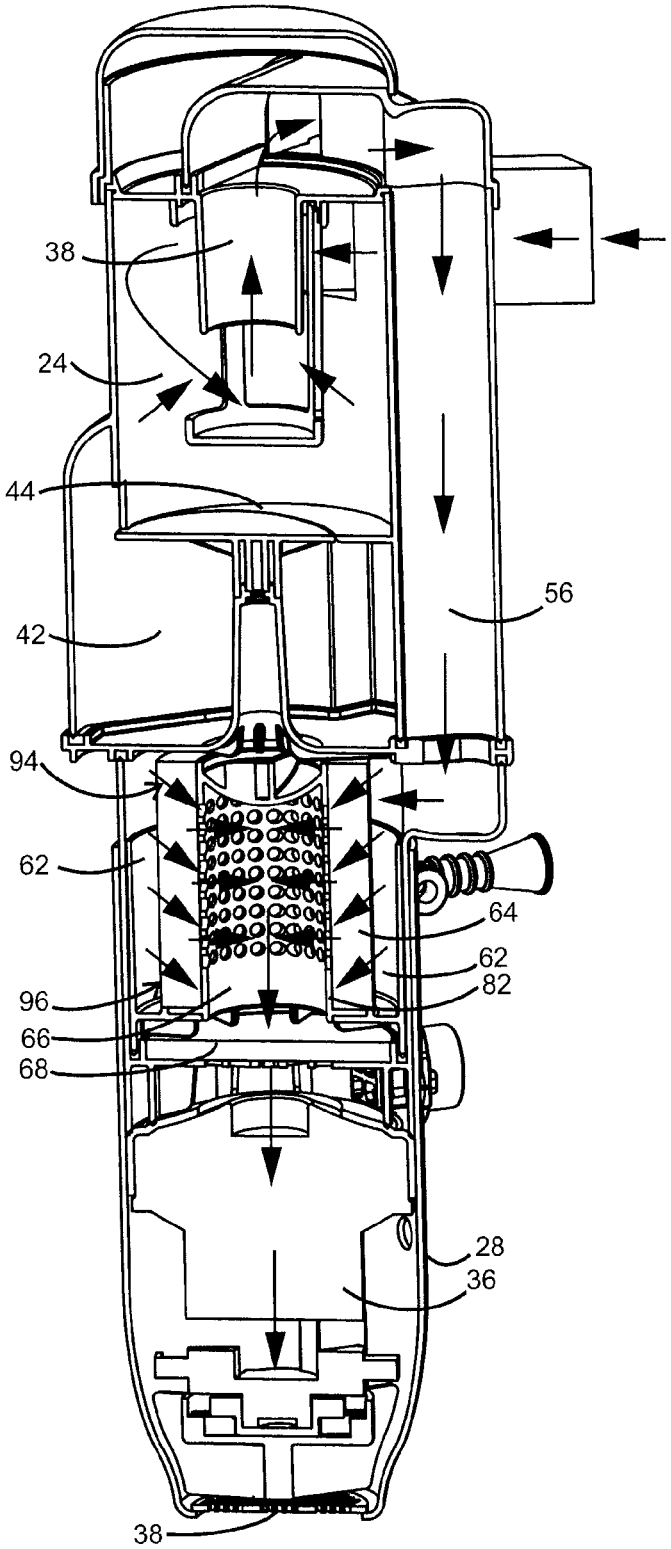
FIG. 5 is a flow diagram through a cyclone, the pre-motor filter and a suction motor according to the embodiment of FIG. 4.
Figure 6:
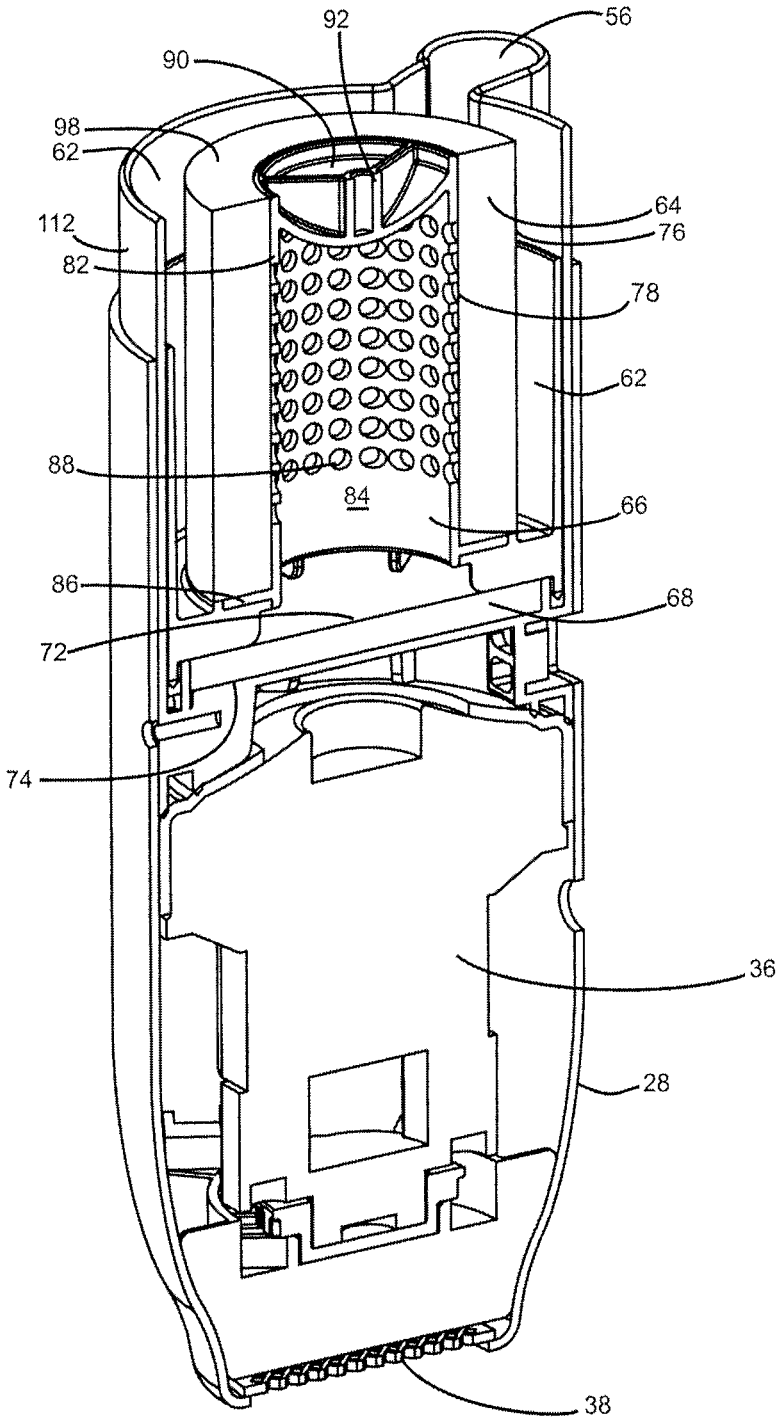
FIG. 6 is a perspective vertical section of the embodiment of FIG. 4.
Figure 7:
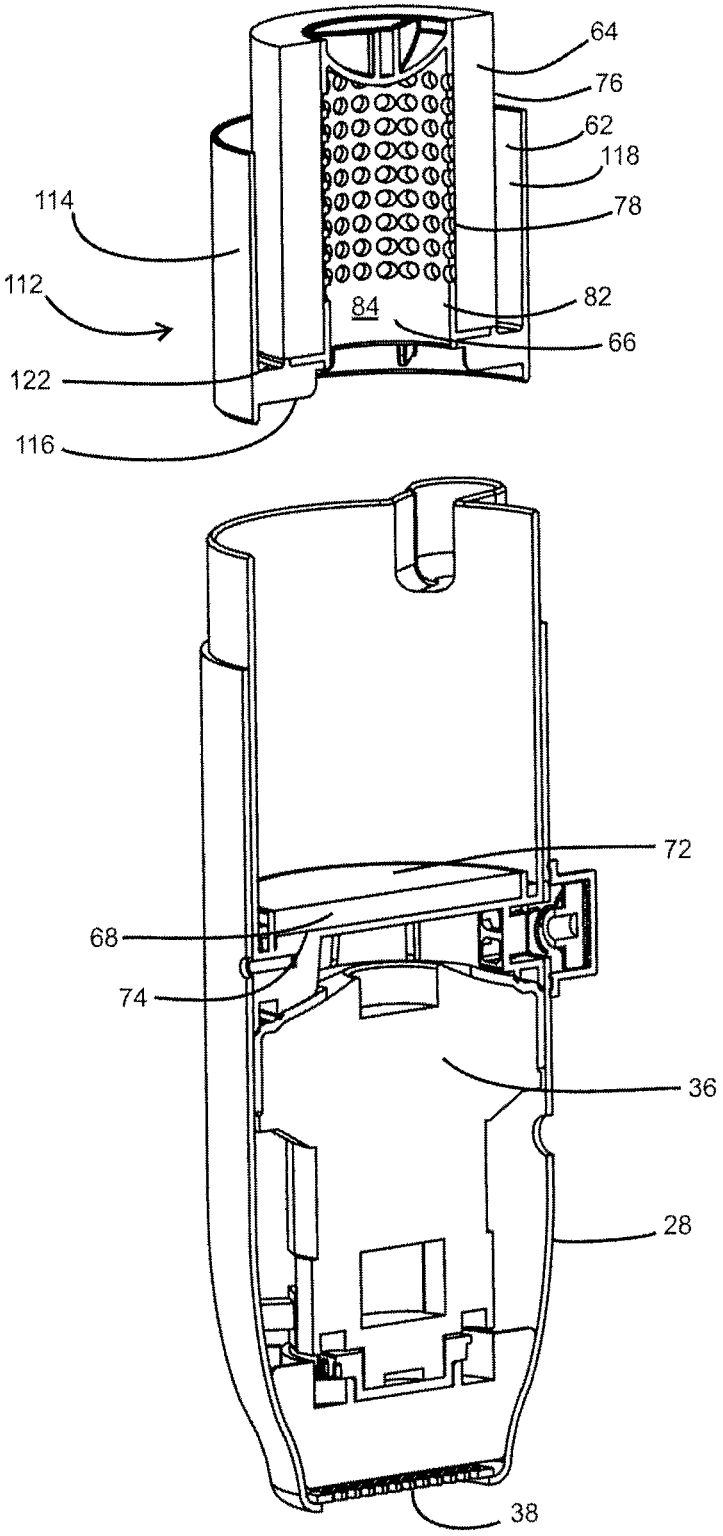
FIG. 7 is a partially exploded perspective vertical section of the embodiment of FIG. 4.
Figure 8:
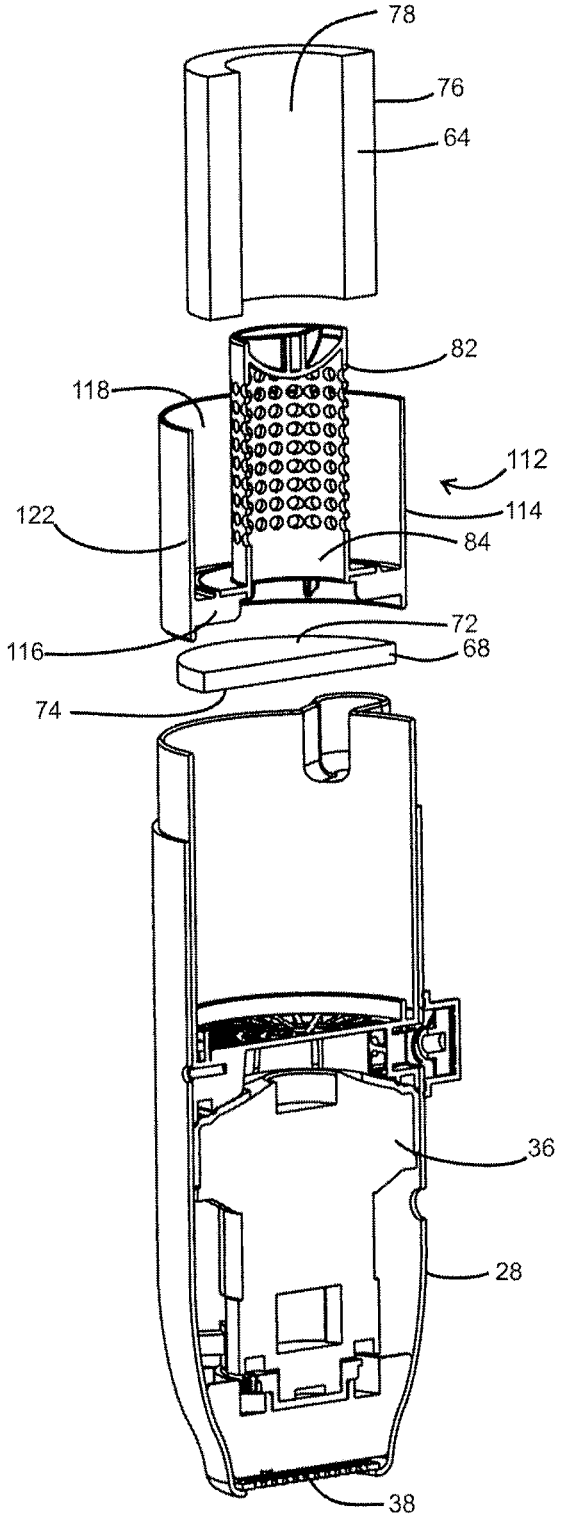
FIG. 8 is a further exploded perspective vertical section of the embodiment of FIG. 4.

Filter 64, may be considered to have an upstream end 94 and a downstream end 96. As shown in FIG. 5, upstream end 94 is the end of filter 64 at the entrance end of longitudinally extending upstream airflow passage 62. Conversely, downstream end 96 is at the distal end of longitudinally extending upstream airflow passage from the entrance to the passage 62. Therefore, as shown in FIG. 5, upstream end 94 is positioned adjacent the exit from down flow conduit 56.

FIG. 2 exemplifies a particular embodiment of a longitudinally extending filter assembly according to one embodiment of this disclosure. Longitudinally extending filter 64 has a filter axis 70 and is oriented such that the upstream face 76 is parallel to the direction of the air stream when it reaches the upstream end of filter 64. As exemplified, filter axis 70 is parallel to cyclone axis 50 and suction motor axis 52. Further, filter axis 70 is common (i.e., co-axial) with suction motor axis 52 and is laterally offset from cyclone axis 50. In an alternate embodiment, it will appreciated that filter axis 70 may be common with cyclone axis 52 and may be laterally offset from suction motor axis 52. Further, it will be appreciated that all three axes 50, 52 and 70 may be laterally offset from each other but generally parallel or they may be co-axial.

Referring still to FIG. 2, it can be seen that optional disc shaped filter 68 has an upstream side 72 and a downstream side 74. Upstream and downstream sides 72 and 74 define the face of filter 68 that have the largest surface areas. Further, these faces are transverse to the axis 52 of suction motor 36 and axis 50 of cyclone 24.

In contrast, pre-motor filter 62 is a longitudinally extending filter member which has an upstream surface 76 and a downstream surface 78. The upstream and downstream surfaces are exemplified as being parallel to the filter axis 70 as well as parallel to cyclone axis 50 and motor axis 52. Accordingly, the air may travel through plenum 60 to the longitudinally extending upstream air-flow passage 62 and then travel inwardly or transversally through filter 64. As such, a larger upstream surface area may be presented to the post-cyclone air-flow stream. Accordingly, upstream surface 76 defines a longitudinally extending peripheral wall of filter 64.

It will be appreciated that upstream and/or downstream surfaces 76 and 78 may not be exactly parallel to one or both cyclone axis 50 and suction motor 52. Further, it will be appreciated that the air may not travel exactly transversely through filter 64. For example, as exemplified by the arrows C, the air may travel inwardly and downwardly (i.e. in the direction of suction motor 36) through filter 64.

It will be appreciated that, in an alternate embodiment, the air may travel transversely or outwardly through longitudinally extending filter media 64. For example, the air exiting conduit 56 may be in fluid communication with the center passage in filter 64 and then be directed outwardly through filter 64 to the passage adjacent the outer surface. In such a case, reference numeral 66 would define the longitudinally extending upstream air flow passage and reference numeral 62 would denote the longitudinally extending downstream air flow passage. In either case, the inner or outer longitudinally extending surface of filter 64 would be presented as an upstream air flow side of filter 64 and would provide an enhanced surface area for filtration. In either case, it will be appreciated that a substantially larger surface area may be provided for filtration than by the use of a disc shaped filter 68. For example, if disc shaped filter 68 would to have the same upstream surface area as filter 64, then the diameter of filter 68 would have to be substantially increased which would require a substantial increase in the width or diameter of upper housing 14. However, the diameter or footprint of upper housing 14 may be maintained relatively small by increasing the height of filter 64 and utilizing its longitudinally extending sides as the upstream surface.

Figure 3:
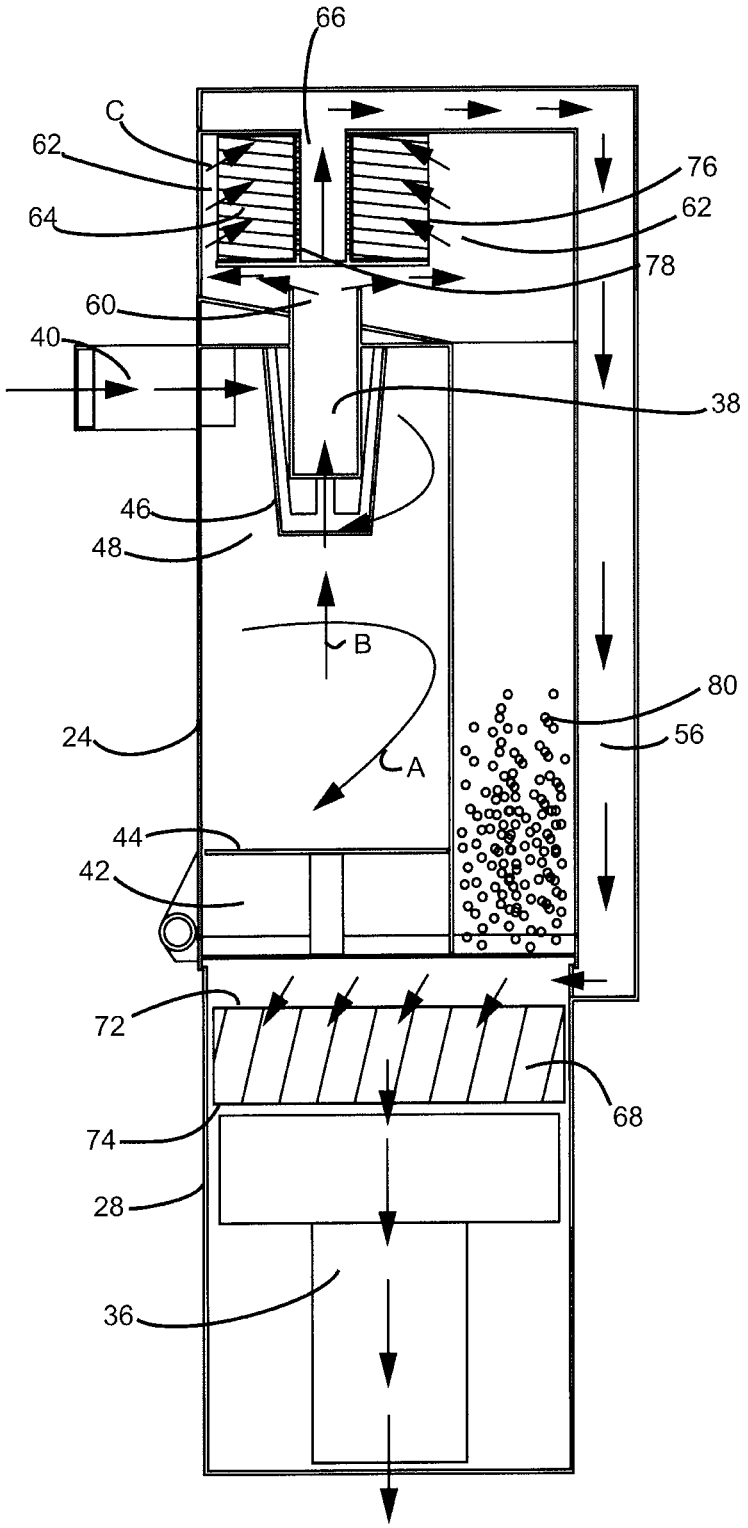
FIG. 3 is a vertical section through a cyclone, a pre-motor filter and a suction motor according to another embodiment of this disclosure.
Figure 4:
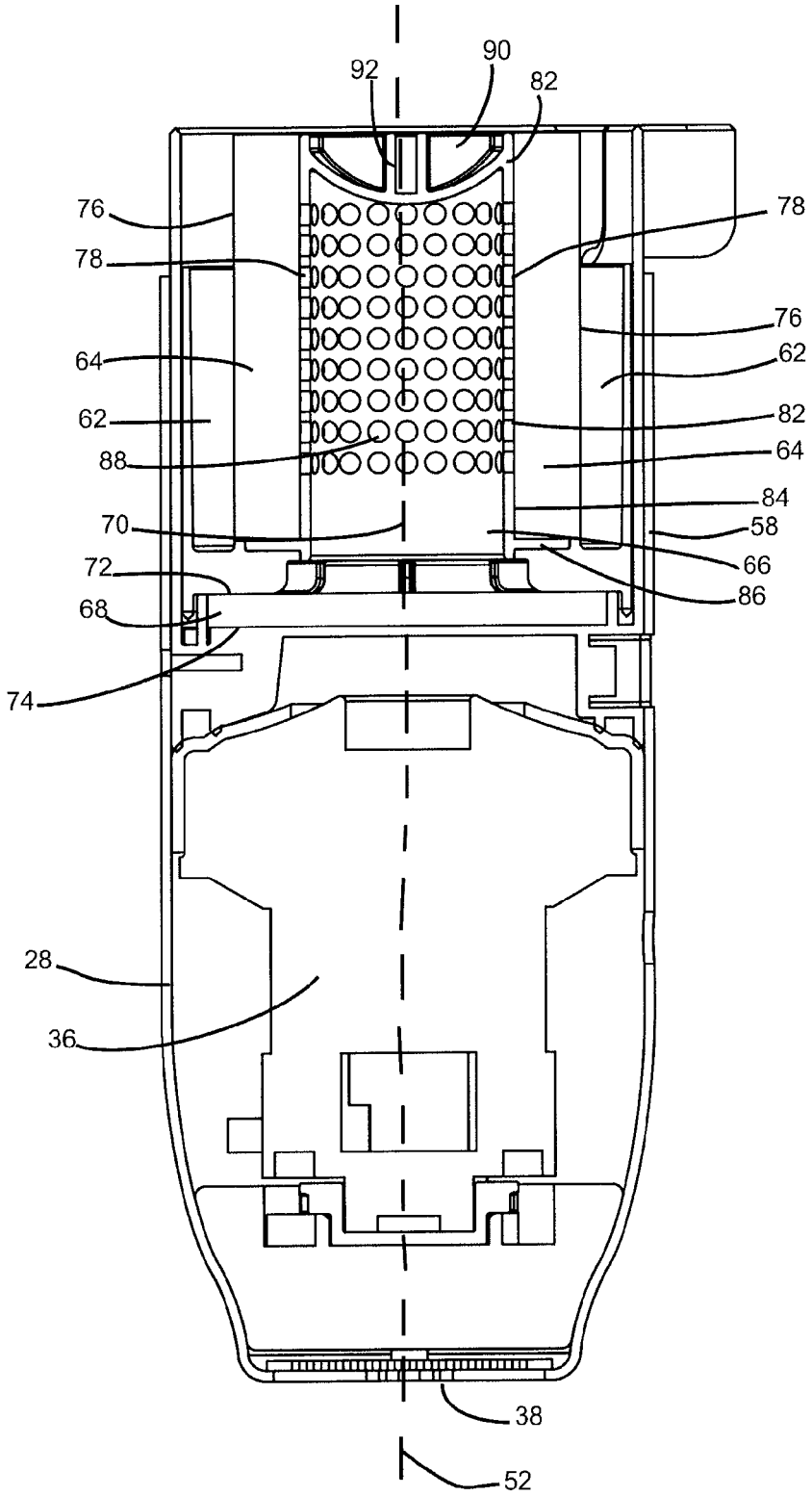
FIG. 4 is an enlarged vertical section through a pre-motor filter and a suction motor according to one embodiment of this disclosure.

An alternate embodiment is exemplified in FIG. 3 wherein the longitudinally extending filter media 64 is positioned above cyclone 24. In this example, the air exiting vortex finder 38 travels laterally through plenum 60 to then travel upwardly through longitudinally extending upstream air flow passage 62. The air then travels laterally or inwardly through filter 64 to longitudinally extending downstream air flow passage 66. The air may be then conveyed laterally and downwardly through down flow conduit 56 to optional disc shaped filter 68. It will be appreciated that, in a further alternate embodiment, suction motor and/or disc shaped filter 68 may be positioned above longitudinally extending filter media 64.

Still referring to FIG. 3, an optional filter dirt chamber 80 may be provided. Dirt may accumulate on the upstream surface 76 of filter 74. This dirt may become dislodged during operation of the vacuum cleaner or movement of the vacuum cleaner. As exemplified, a side passage which is adjacent and parallel to cyclone 24 is provided (i.e. filter dirt chamber 80). Dirt may accumulate therein until it may be optionally emptied. As discussed subsequently, the dirt chamber may be a recess in the bottom of the housing for filter 64 is the air travels downwardly through passage 62.

Figure 21:
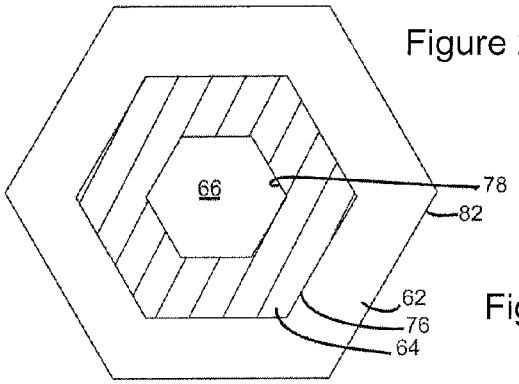
FIG. 21 is a top plan view of an alternate configuration of a pre-motor filter and filter holder according to another embodiment of this disclosure.
Figure 22:
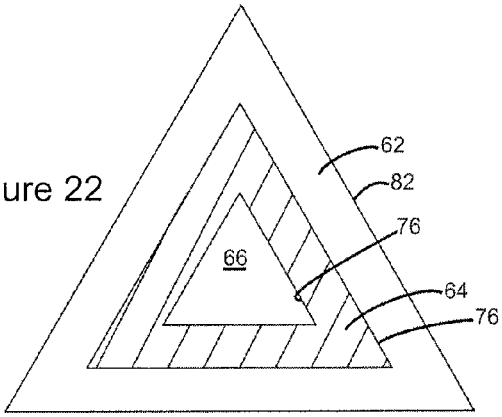
FIG. 22 is a top plan view of a further alternate configuration of a pre-motor filter and filter holder according to another embodiment of this disclosure.
Figure 23:
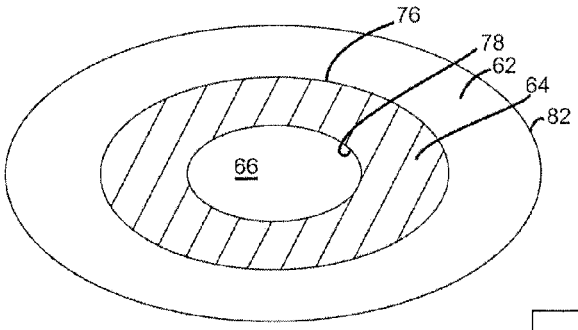
FIG. 23 is a top plan view of a further alternate configuration of a pre-motor filter and filter holder according to another embodiment of this disclosure.
Figure 24:
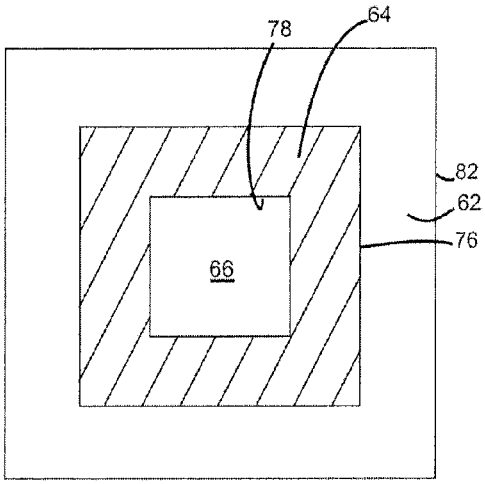
FIG. 24 is a top plan view of a further alternate configuration of a pre-motor filter and filter holder according to another embodiment of this disclosure.
Figure 25:
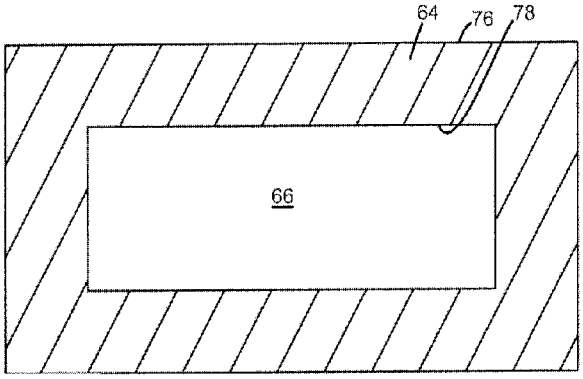
FIG. 25 is a top plan view of a further alternate configuration of a pre-motor filter and filter holder according to another embodiment of this disclosure.
Figure 26:
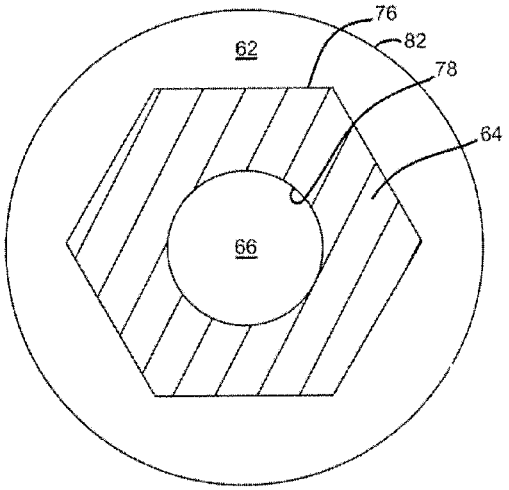
FIG. 26 is a top plan view of a further alternate configuration of a pre-motor filter and filter holder according to another embodiment of this disclosure.
Figure 27:
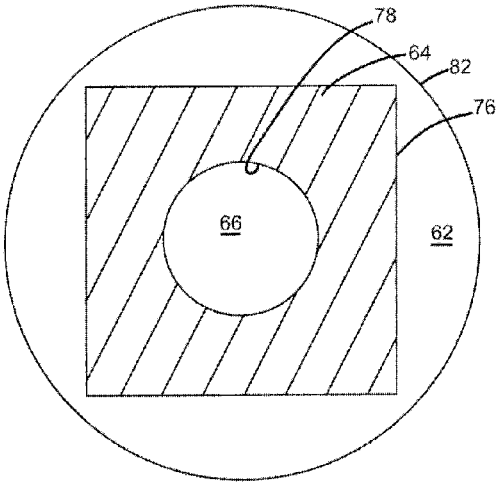
FIG. 27 is a top plan view of a further alternate configuration of a pre-motor filter and filter holder according to another embodiment of this disclosure.

In a preferred embodiment, filter 64 is annular or substantially annular. As exemplified in FIGS. 4-11, filter 64 is annular. This enhances the surface area of upstream surface 76 and defines a hollow body. It will be appreciated that, in some embodiments, the filter 64 may describe other three-dimensional shapes and still be annular. For example, the filter, in transverse section may be circular (see for example FIG. 9) or hexagonal (see for example FIG. 21), triangular (see for example FIG. 22), elliptical (see for example FIG. 23), square (see for example FIG. 24), rectangular (see for example FIG. 25) or any other shape. It will also be appreciated that the inner and outer surfaces 76, 78 may be of different shapes in transverse section. Preferably, the interior is circular if the interior defines the downstream air flow passage 66. The exterior surface (which preferably defines a portion of the upstream air flow passage 62), may be of any shape such as hexagonal (see FIG. 26), square (see FIG. 27) or any other shape. It will be appreciated that if the interior is the upstream air flow passage, that the interior surface may be of any shape and the exterior surface may be circular in transverse section. It will be appreciated that, in some embodiments, the filter 64 may describe part of a circle or other three-dimensional shape.

In accordance with another preferred embodiment, the longitudinally extending filter media 64 is preferably provided with or mounted on a filter holder 82. As will be appreciated, the filter 64 may be relatively long and hollow and may be made of foam. As such, under the air flow induced in a vacuum cleaner, substantial pressure may be applied to upstream surface 76 of filter 64 thereby possibly deforming and, in an extreme case, collapsing filter 64 (e.g. the interior air flow passage 66 may be reduced in the cross section area and it might even be closed). Accordingly, a filter holder is preferably provided to maintain the shape of filter 64. It will be appreciate that the filter holder may be of various shapes and configurations depending upon the shape of filter 64. In the exemplified embodiment of FIGS. 4-11, filter 64 is cylindrical in shape and has an open interior passage. The air flows inwardly to the central passage. Accordingly, the filter holder preferably has a support wall 84 which is provided interior of filter 64. It will be appreciated that, if the air flow travels outwardly through filter 64, then the support wall may be positioned on what is surface 76 in FIG. 4. In other words, it is preferred that the support wall be provided for the downstream surface of filter 64. It will be appreciated that support wall may be of various shapes and configurations and may alternately or in addition be provided on the upstream surface or interior to filter 64.

Figure 9:
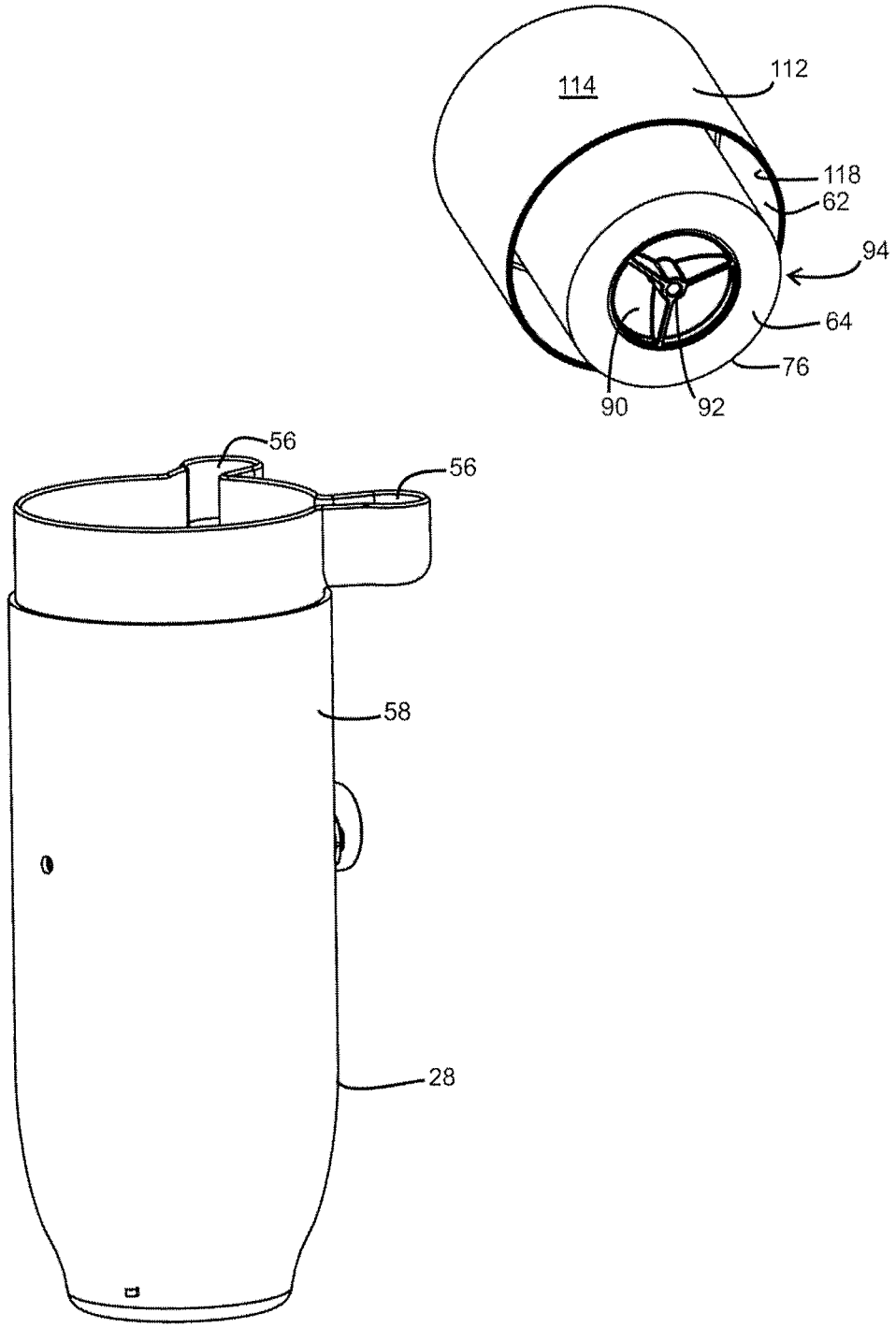
FIG. 9 is a perspective view of the embodiment of FIG. 4 wherein the filter assembly has been removed and inverted for emptying.
Figure 10:
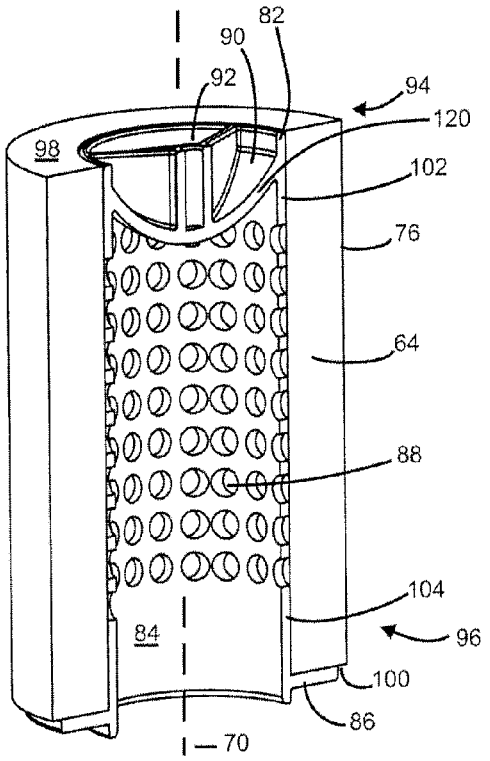
FIG. 10 is an enlarged perspective view of the pre-motor filter and filter holder of FIG. 4.
Figure 11:
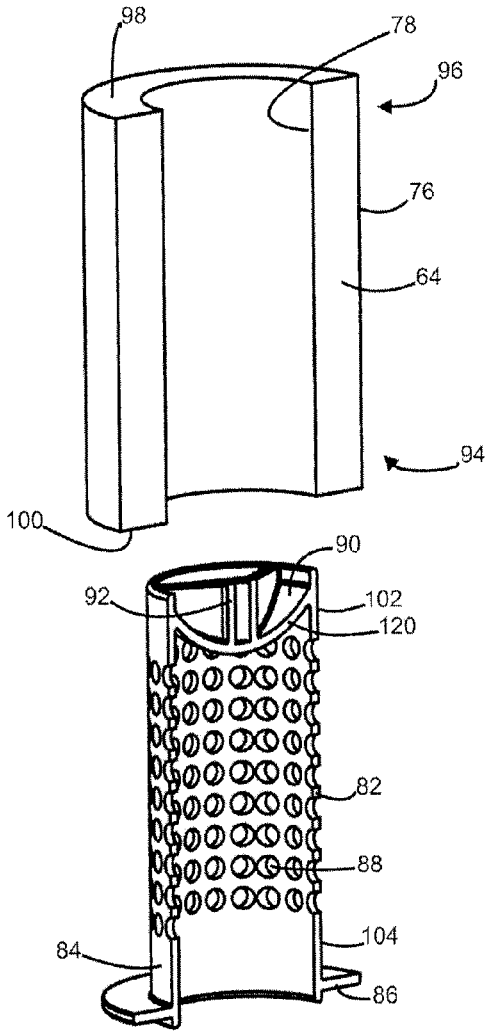
FIG. 11 is an exploded view of FIG. 10.
Figure 13:
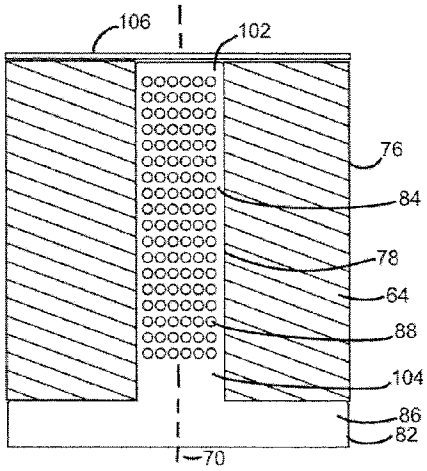
FIG. 13 is a vertical section of a further alternate pre-motor filter and filter holder according to this disclosure.

As exemplified in particular in FIGS. 10 and 11, filter holder 82 comprises a cylindrical support wall 84 mounted on a base 86 Preferably, as exemplified in the embodiments of FIGS. 7-13, end wall 120 which is solid is provided so as to close the upstream end of downstream air flow passage 66. As exemplified, support wall 84 is annular and is received inside filter 84 such that downstream surface 78 seats against or presses against wall 84. Preferably, base 86 is provided to provide a bottom surface against which filter 64 may seat. This may assist in properly positioning filter 64 on wall 84. It will be appreciated that, in alternate embodiment, a base 86 may not be provided. Further, base 86 may be the same size as downstream end 96 of filter 64 or may be smaller or larger. Another advantage of base 86 is that it may prevent air entering filter 64 via downstream face 100.

Preferably, filter 64 is compressed against support wall 84. The compression of the foam assists in maintaining foam 64 against support wall 84 and will therefore assist in preventing air bypassing filter 64. For example, if the foam fits loosely against support wall 64, it is possible that some air may flow between upstream surface 76 and support wall 84 if there is a gap therebetween or if there is a loose fit. Preferably, the compression of the foam is from 0.1-10 millimeters, more preferably from 0.5-5 millimeters and, more preferably from 1-2.5 millimeters. It is preferred to limit the compression of the foam since excessive compression may result in closing a number of the open cells in the foam which will increase the back pressure through the vacuum cleaner.

It will be appreciated that support wall 84 is configured to allow air flow therethrough. In the exemplified embodiment of FIGS. 10 and 11, the support wall has a plurality of perforations 88 formed therein. It will be appreciated that, in other cases, support wall 84 may be a grill, open lattice or merely a plurality of support ribs.

Preferably, filter 64 or the filter assembly is provided with a handle to manipulate the filter assembly. An advantage of the handle is that a consumer need not touch filter 64 and, in particular, upstream surface 76 of filter 64 when removing filter 64 for cleaning or replacement. As exemplified, handle 92 is provided in a recess 90 provided at an upper and (e.g. the upstream end) of support wall 84. It will be appreciated that handle 92 need not be recessed interior of filter 64 (see for example FIG. 14). However, handle 92 may be advantageously recessed into the hollow interior of filter 64 so as to reduce the profile of the filter assembly. In particular, by recessing handle 92 into filter 64, handle 92 need not extend above filter 64. For example, handle 92 may be flush with the upper surface of filter 64. It will be appreciated that in alternate embodiments as exemplified in FIG. 12, a handle 92 may not be provided.

It is preferred that filter 64 and/or the filter assembly be configured so as to inhibit and, preferably prevent, air from following a shorter flow route through the filter 64. In other words, filter 64 and/or the filter assembly may be designed such that the air will travel a minimum desired distance through filter 64. For example, if perforations 88 extended all the way to upstream end 94, it is possible that some air may travel through upstream face 98 of filter 64 and travel directly through perforations 88 into longitudinally extending airstream airflow passage 66.

In one embodiment, such a short flow route through the filter 64 may be inhibited by providing an upstream portion 102 of support wall 84 that is solid or air impermeable. Accordingly, as show in FIGS. 10 and 11, upstream portion 102 is not provided with any perforations.

In order to prevent or inhibit bypass of air or the short circuiting of air through filter 64, at the downstream end 96 of filter 64, it is preferred to have a base 86 upon which downstream face 100 of filter 64 seats. In addition, it is preferred that downstream portion 104 of support wall 84 is also solid or air impervious (i.e. there are no perforations 88). Accordingly, the travel of air around downstream face 100 of filter 64 into downstream airflow passage 66 may be inhibited.

Accordingly, it is preferred that a portion of either longitudinal end of support wall 84 not be air impermeable. In a particularly preferred embodiment, both upstream and downstream portions 102 and 104 of support wall 84 are air impervious, however, it would appreciated that, in some embodiments, one or both of upstream and downstream portions 102 and 104 may permit airflow therethrough. Accordingly, upstream and downstream portions 102 and 104 may be solid portions and the remainder of support wall 84 positioned there between may be considered a central portion which is provided with the opening or perforations 88.

Preferably, upstream portion 102 is from 0.1-25, more preferably 2-15 and, most preferably 8-15 millimeters in length. Similarly, downstream portion 104 preferably has a length which is selected from the same ranges.

Alternate constructions of filter 64 and filter holder 82 may be used so as to reduce the bypass or short circuiting of air through filter 64. For example, as exemplified in FIG. 13, upstream wall 106 may be provided on upstream face 98 of filter 64 so as to prevent air entering filter 64 via upstream face 98. Accordingly, wall 106 may perform the same function as base 86. In this embodiment, base 86 overlies all of downstream face 100 and upstream wall 106 overlies all of upstream base 98. Accordingly, as exemplified, perforations 88 may extend all the way or essentially all the way to the upper end of support wall 84 and, accordingly, upstream portion 102 may include perforations and may optionally not include any air impermeable portion. Similarly, downstream portion 104 may also contain perforations. However, as exemplified in FIG. 13, the downstream portion 104 may be air impervious.

Figure 14:
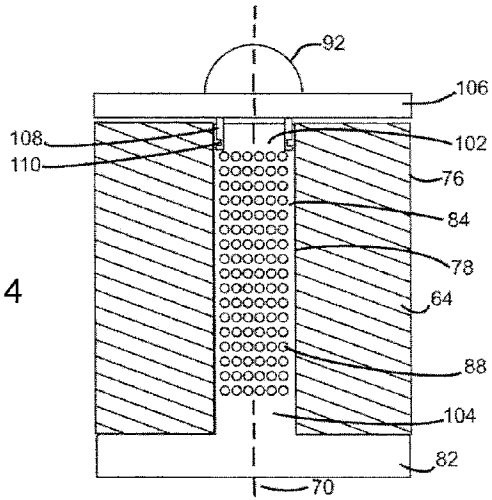
FIG. 14 is a vertical section of a further alternate pre-motor filter and filter holder according to this disclosure.

A further alternate embodiment is shown in FIG. 14. In this embodiment, upper wall 106 is provided with handle 92.

Upper wall may be provided with legs which are securable to the interior of wall 84, such as via notches 110 that receive protrusions provided on the inner surface of wall 84.

Figure 15:
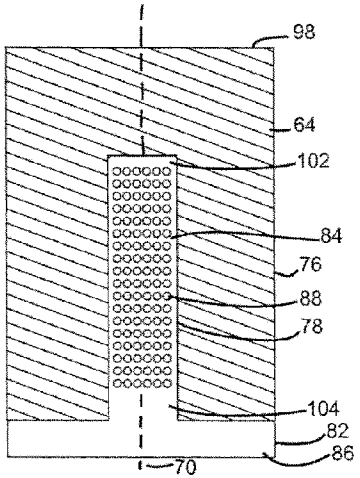
FIG. 15 is a vertical section of a further alternate pre-motor filter and filter holder according to this disclosure.
Figure 12:
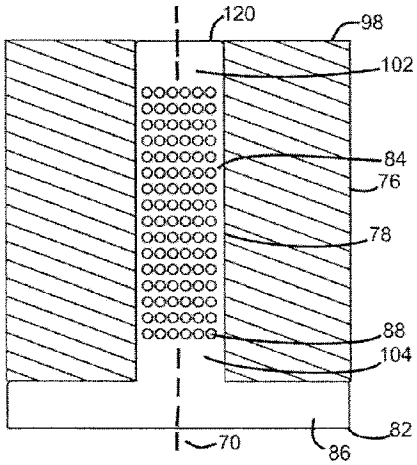
FIG. 12 is a vertical section of an alternate pre-motor filter and filter holder according to this disclosure.

In another alternate embodiment, as exemplified in FIG. 15, filter 64 may be constructed such that upper face 98 is positioned sufficiently above upper end 102 such that air may also enter filter 64 via upstream face 98 and still pass through a desired amount of the filter media. In such an embodiment, an upper wall 106 is not required. However, it is still preferred to provide a downstream portion 104 which has an absence of perforations or the like. If foam is provided above upstream end 102 as exemplified in FIG. 15, then the thickness of the portion of the foam in the longitudinal direction (i.e. in the direction of filter axis 70) that extends above upstream end 102 is preferably from 0.1-25, more preferably 2-15 and, most preferably 8-15 millimeters in length. Accordingly, it will be appreciated that in this embodiment, upstream portion 102 may have an open end (i.e. it need not be solid).

It is also preferred that the filter 64 is compressed in the longitudinal direction. For example, upstream wall 106 may be utilized to compress filter 64 longitudinally between base 86 and upstream wall 106. The filter 64 may be compressed longitudinally from 0.1-10, preferably from 0.5-5, and most preferably from 1-2.5 millimeters.

It will be appreciated that, in some embodiments, filter holder 82 may be provided on or in a filter holder mount 112. Preferably, the filter holder mount 112 is utilized to define a wall of one of the upstream and downstream air flow passages 62, 66. For example, as exemplified in FIGS. 7-9, filter holder mount 112 has a longitudinally extending sidewall 114 and base 116 on which filter holder 82 is seated or mounted. As such, upstream air flow passage 62 is defined between inner surface 118 of sidewall 114 and upstream surface 76 of filter 64. It will appreciated that, if the air travels from the interior from filter 64 outwardly, then sidewall 114 may define a portion of downstream air flow passage 66. As exemplified, filter holder mount 112 need not extend along the entire longitudinal extent of filter 64 but may only extend along a portion thereof. An advantage of filter holder mount 112 is that sidewall 114 may also be utilized by a consumer to manipulate filter 64. In alternate embodiments, it will be appreciated that a filter holder mount 112 may not be provided. For example, as exemplified in FIGS. 2 and 3, the outer wall of upstream passage 62 is defined by the inner surface of filter housing 58.

In another preferred embodiment, a dirt collection recess 122 may be provided. Such a recess is exemplified in FIGS. 7 and 8. As shown therein, filter 64 is seated in filter holder amount 114 such that the downstream end of filter 64 is positioned above the floor of base 116 of filter holder amount 114 so as to define recess 122. In the exemplified embodiment, this is achieved by having base 86 of filter holder 82 positioned above the inner surface of base 116 of filter holder amount 114 so as to define dirt collection recess 122. An advantage of this design is that dirt which may accumulate on the upstream surface 76 of filter 64 may become dislodged and, if so, may accumulate below filter 64. This dirt may be emptied, for example, when filter 64 is removed from the surface cleaning apparatus and inverted as shown in FIG. 9. It will be appreciated that various other constructions may be utilized to define a dirt collection recess 122. For example, filter housing 58 may be constructed so that filter holder 82 is received directly therein and filter housing 58 may have a portion which defines dirt collection recess 122.

It will accordingly be appreciated that the filter assembly may comprise filter 64 together with filter holder 82 and filter holder mount 112. However, as also exemplified herein, a filter holder mount 112 is not required and the filter assembly may comprise filter 64 and filter holder 82. In such a case, the filter housing 58 itself, or at some other portion of the surface cleaning apparatus, may be utilized to define one of the air flow passages 62, 64.

Figure 16:
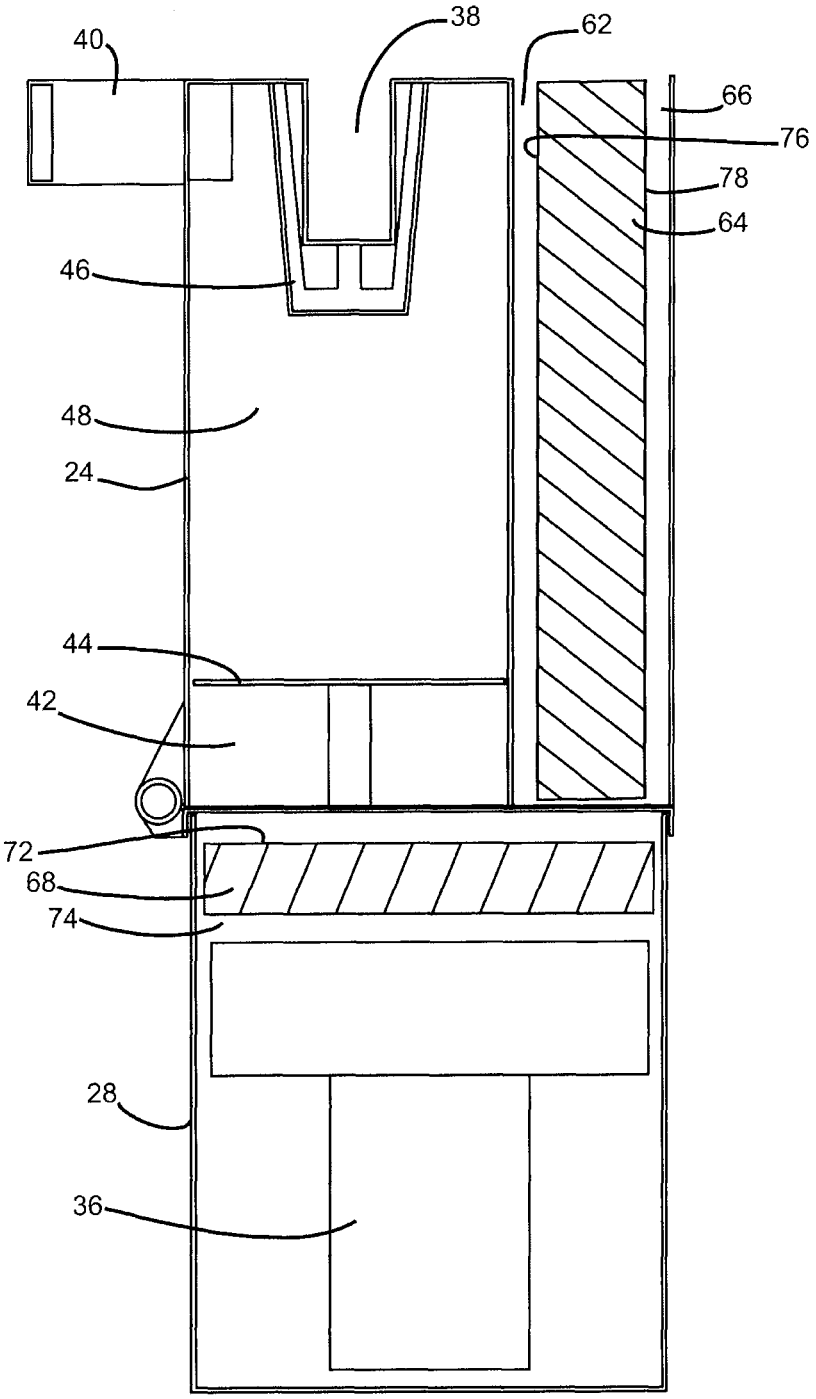
FIG. 16 is a vertical section of a further alternate embodiment according to this disclosure.
Figure 17:
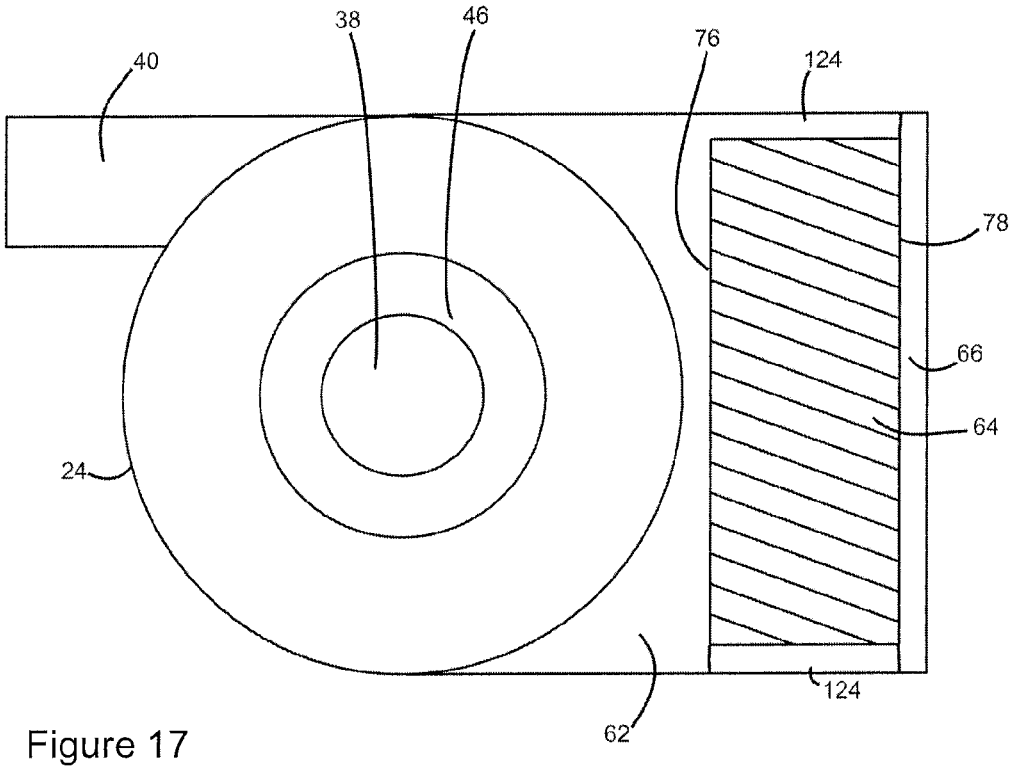
FIG. 17 is a top plan view of the embodiment of FIG. 16.
Figure 18:
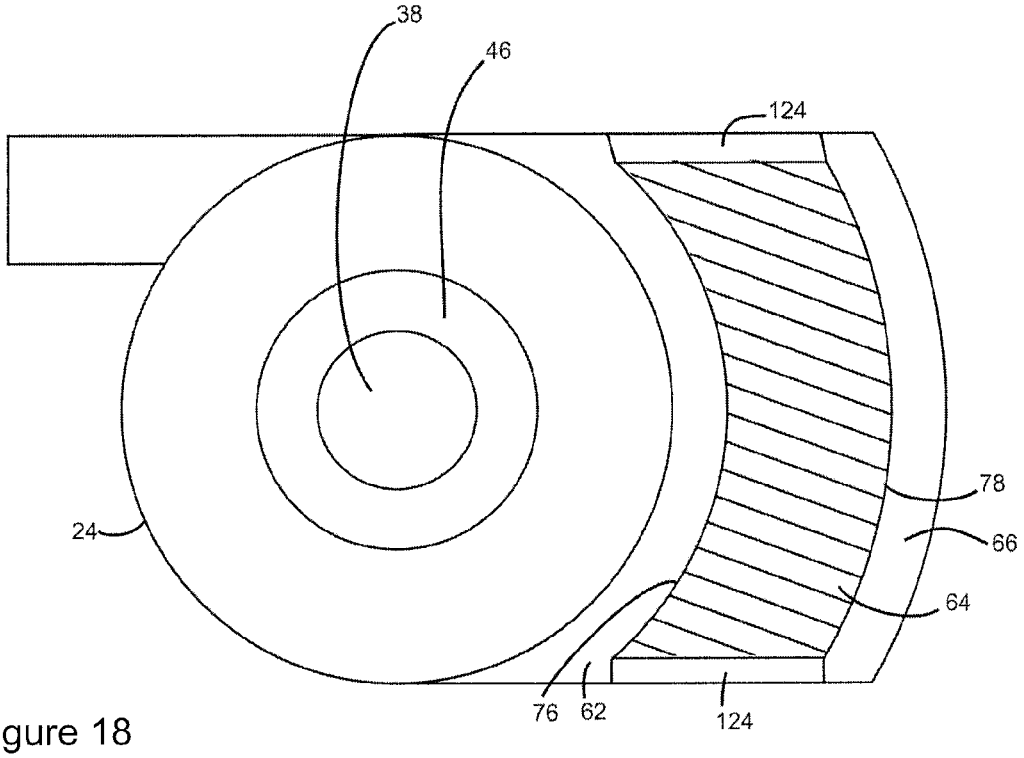
FIG. 18 is a top plan view of an alternate embodiment of FIG. 16.

It will be appreciated that filter 64 may be provided at various locations in the surface cleaning apparatus. For example, in addition to being position above or below cyclone 24, filter 64 may be position adjacent (i.e. laterally spaced from) cyclone 24. Such an embodiment is exemplified in FIGS. 16-20. As exemplified in FIGS. 16 and 17, filter 64 is rectangular in shape and is mounted between filter holders 124 which are provided on the inner surface housing defining the cyclone 24 or in which cyclone 24 is provided. Accordingly, the air may exit cyclone 24 via vortex finder 38 and travel laterally and downwardly through upstream air flow passage 62. The air may travel laterally through filter 64 to downstream air flow passage 66 and then to optional disc shaped filter 68 and suction motor 36. Accordingly, in such an embodiment, filter 64 need not be a hollow body. Instead, the housing of the vacuum cleaner may be constructed to define air passages 62, 66 with filter 64 mounted therebetween. In addition, to increase the surface area of filter 64, in such an embodiment, filter 64 need not be linear in shape. For example, as exemplified in FIG. 18, filter 64 may be arcuate in shape.

Figure 19:
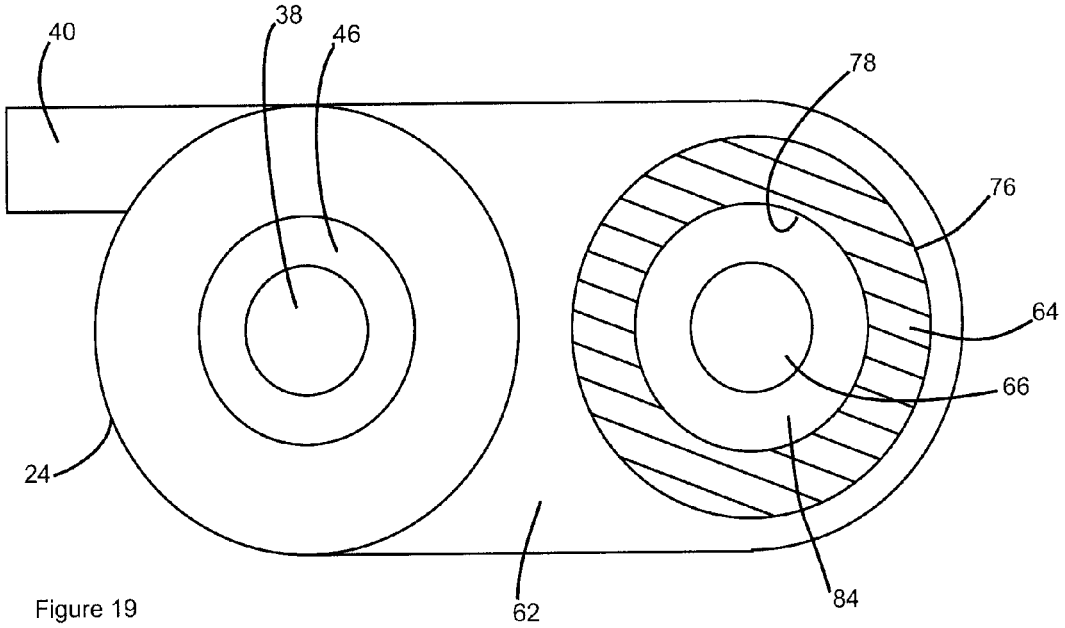
FIG. 19 is a top plan view of a further alternate embodiment of FIG. 16.
Figure 20:
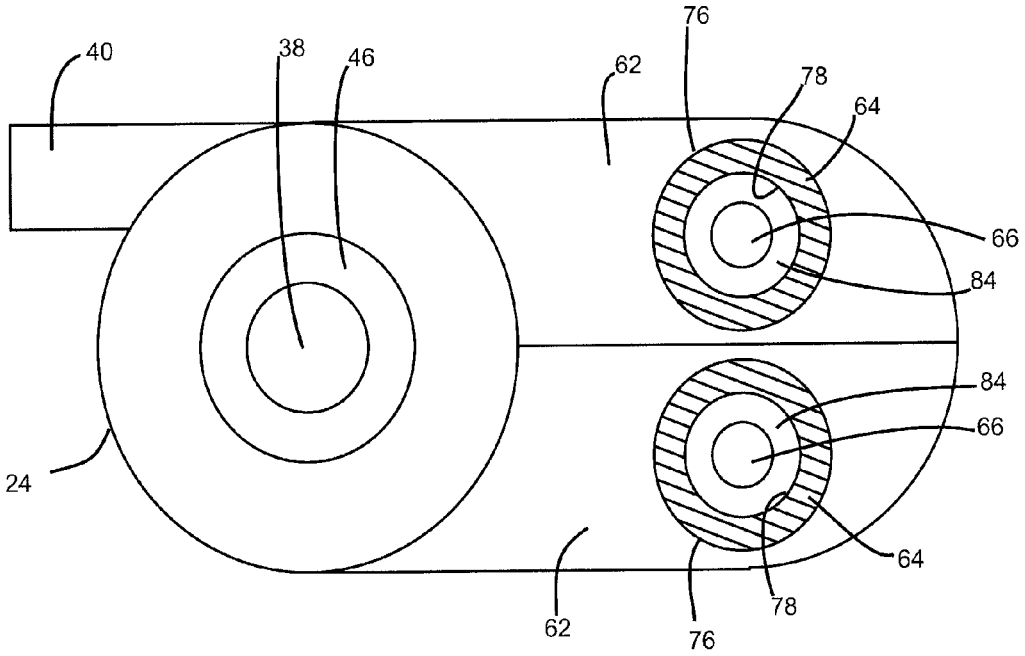
FIG. 20 is a top plan view of a further alternate embodiment of FIG. 16.

It will also be appreciated that in an embodiment wherein the filter 64 is adjacent cyclone 24, filter 64 may still be a hollow body. Such a configuration is shown in FIGS. 19 and 20. As shown in FIG. 19, a single filter 64 is provided parallel to and laterally spaced from cyclone 24. In the embodiment of FIG. 20, two filters 64 are provided in parallel. The two filters are parallel to, and laterally spaced from, cyclone 24.

Filter 64 may be made by various techniques. For example, if filter 64 is a hollow body as exemplified in FIG. 20, then filter 64 may be extruded. Alternately, if filter 64 is a solid flat body as exemplified in FIG. 17, filter 64 may be cut from a piece of foam or molded to the exact shape. Alternately, filter 64 may be made from a single piece of foam which is folded or curved to the desired shape. For example, in the embodiment of FIG. 28, filter 64 is prepared by curving a flat piece of foam about a central axis to define a hollow body and joining first and second ends 126 and 128 to create a tubular body. Alternately, as exemplified in FIG. 29, four pieces of foam 130, 132, 134 and 136 are, e.g., glued or welded together to define a hollow square filter 64. Similarly, in FIG. 30 six pieces of foam 130, 134, 138, 140, 142, 144 are, e.g., glued or welded together to define a square filter 64.

It will be appreciated that, in some embodiments, a secondary filter may be provided co-extensively with filter 64. For example a second filter media may be provided on one of the upstream and downstream surfaces 76, 78 of filter 64 and, preferably, on the downstream surface 78. Preferably, the additional filter member will filter particulate matter having a different size from that of filter 64. If the second filter member is on the downstream surface, then it will preferably filter finer particulate matter and, if it is provided on the upstream face, then it will filter coarser particulate matter. In a particularly preferred embodiment, the secondary filter member is provided on downstream surface 78 and comprises a felt filter.

It will be appreciated that the following claims are not limited to any specific embodiment disclosed herein. Further, it will be appreciated that one or more of the features disclosed herein may be used in any particular combination or sub-combination. Further, what has been described herein has been intended to be illustrative of the invention and non-limiting and it will be understood by a person skilled in the art that other variants and modifications may be made without departing from the scope of the invention as defined in the claims appended hereto.

The invention claimed is:

1. A surface cleaning apparatus comprising:

a) an air flow passage extending from a dirty air inlet to a clean air outlet;

b) an air treatment member positioned in the air flow passage;

c) a suction motor positioned in the air flow passage and having a motor axis; and, d) a filter assembly downstream of the air treatment member and upstream of the suction motor, the filter assembly comprising a first end having a first end wall, a longitudinally extending filter support wall and a longitudinally extending foam filter media, the longitudinally extending filter support wall defining a hollow interior which has first and second longitudinally spaced apart ends and a longitudinal axis, the first end of the hollow interior closed by the first end wall, the filter support wall having first and second longitudinally spaced apart ends and a central portion that is spaced from each of the first and second ends by solid portions, wherein each of the solid portions and the central portion extends continuously around a perimeter, the central portion having a plurality of openings, the filter media having a longitudinally extending outer wall which is an upstream wall and a longitudinally extending inner wall which is a downstream wall and which defines a hollow interior of the filter media, wherein the filter support wall is located downstream of the downstream wall of the filter media and the filter media overlies each of the solid portions wherein each of the solid portions has a height in the longitudinal direction sufficient to inhibit bypass of the foam filter media.

2. The surface cleaning apparatus of claim 1 wherein the filter media has a longitudinally extending filter axis that is generally parallel to the motor axis.

3. The surface cleaning apparatus of claim 1 wherein the filter assembly has a downstream end having a dirt collection recess.

4. The surface cleaning apparatus of claim 1 wherein the filter media is annular.

5. The surface cleaning apparatus of claim 1 wherein the filter assembly further comprises a spaced apart outer wall facing the upstream side of the filter media.

6. The surface cleaning apparatus of claim 5 wherein a longitudinally extending upstream air flow passage is positioned between the outer wall and the filter media and a longitudinally extending downstream air flow passage is positioned on an inner side of the filter support wall.

7. The surface cleaning apparatus of claim 6 wherein the filter media is annular and the longitudinally extending downstream airflow passage is positioned inside the filter media.

8. The surface cleaning apparatus of claim 7 wherein the longitudinally extending upstream airflow passage has a dirt collection recess at the downstream end.

9. The surface cleaning apparatus of claim 5 wherein the longitudinally extending downstream air flow passage has an end open adjacent the upstream end and the filter media also overlies the open end.

10. The surface cleaning apparatus of claim 1 further comprising a felt filter downstream from the foam filter media, which has an upstream face that extends transversely to the longitudinal axis.

11. The surface cleaning apparatus of claim 1 wherein the filter media has first and second longitudinally spaced apart ends and the ends are compressed longitudinally inwardly.

12. The surface cleaning apparatus of claim 1 wherein the filter media is compressed against the filter support wall.

13. The surface cleaning apparatus of claim 1 wherein each solid portion has a length from 2-15 millimeters.

14. The surface cleaning apparatus of claim 1 wherein each solid portion has a length from 8-15 millimeters.

15. The surface cleaning apparatus of claim 1 wherein the first end wall comprises a recessed portion that curves inwardly and extends into the hollow interior of the filter media, the filter assembly further comprising a handle provided in the recessed portion, the handle having an outer surface that is substantially flush with the first end of the filter assembly.

16. The surface cleaning apparatus of claim 1, wherein the inner wall of the filter media comprises a secondary filter media different from the foam filter media.

17. The surface cleaning apparatus of claim 16, wherein the secondary filter media comprises felt.

18. A surface cleaning apparatus comprising:

a) an air flow passage extending from a dirty air inlet to a clean air outlet;

b) an air treatment member positioned in the air flow passage;

c) a suction motor positioned in the air flow passage and having a motor axis;

a filter assembly downstream of the air treatment member and upstream of the suction motor, the filter assembly comprising a longitudinally extending foam filter member and a longitudinally extending filter support wall having a perimeter, the filter support wall extending continuously around the perimeter and comprising first and second longitudinally spaced apart ends comprising a solid portion that extends continuously around the perimeter and a portion therebetween that extends continuously around the perimeter and has a plurality of perforations, the filter member comprising a longitudinally extending outer wall which is an upstream wall and a longitudinally extending inner wall which is a downstream wall and which defines a hollow interior of the filter member, wherein the filter support wall is located downstream of the downstream wall of the filter member e).

19. The surface cleaning apparatus of claim 18 wherein the filter member comprises a hollow body.

20. The surface cleaning apparatus of claim 19 wherein the filter member comprises an annular body.

21. The surface cleaning apparatus of claim 19 wherein a longitudinally extending upstream air flow passage is positioned between an outer wall and the filter member and a longitudinally extending downstream air flow passage is positioned inside the filter member.

22. The surface cleaning apparatus of claim 21 wherein the filter assembly has an upstream end and a downstream end and the longitudinally extending upstream airflow passage has a dirt collection recess at the downstream end.

23. The surface cleaning apparatus of claim 18 wherein the filter member has a longitudinally extending filter axis that is generally parallel to the motor axis.

24. The surface cleaning apparatus of claim 18 wherein the filter member has a longitudinally extending filter axis that is generally parallel to the cyclone axis.

25. The surface cleaning apparatus of claim 18 further comprising a downstream felt filter provided interior of the foam filter member.

26. The surface cleaning apparatus of claim 18 wherein each solid portion has a length from 2-15 millimeters.

27. The surface cleaning apparatus of claim 18 wherein each solid portion has a length from 8-15 millimeters.

28. The surface cleaning apparatus of claim 18 wherein the filter assembly further comprises a handle, the handle being located within the hollow interior of the filter member at a longitudinal end of the filter assembly, the handle being substantially flush with the longitudinal end of the filter assembly.

* * * * *

UNITED STATES PATENT AND TRADEMARK OFFICE

CERTIFICATE OF CORRECTION

PATENT NO. : 9,492,045 B2
APPLICATION NO. : 13/416155
DATED : November 15, 2016
INVENTOR(S) : Wayne Ernest Conrad It is certified that error appears in the above-identified patent and that said Letters Patent is hereby corrected as shown below:

In the Claims
Claim 18, Column 14, Line 37, insert --d)-- before "a filter assembly".
Claim 18, Column 14, Line 54, should be blank. There should not be a paragraph numbering "e)".

Signed and Sealed this
Seventeenth Day of January, 2017

Michelle K. Lee

Michelle K. Lee
*Director of the United States Patent and Trademark Office*